US007189080B2

(12) United States Patent
Tang et al.

(10) Patent No.: US 7,189,080 B2
(45) Date of Patent: Mar. 13, 2007

(54) LAND GRID ARRAY CONNECTOR CONTACT

(75) Inventors: Qing-Yi Tang, Shenzhen (CN); Fu-Jin Peng, Shenzhen (CN); Yao-Chi Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/500,527

(22) Filed: Aug. 8, 2006

(65) Prior Publication Data

US 2007/0032102 A1 Feb. 8, 2007

(30) Foreign Application Priority Data

Aug. 8, 2005 (TW) ..... 94213421 U

(51) Int. Cl.
*H01R 12/00* (2006.01)

(52) U.S. Cl. ..... 439/66

(58) Field of Classification Search ..... 439/66
See application file for complete search history.

(56) References Cited

U.S. PATENT DOCUMENTS

| | | | | |
|---|---|---|---|---|
| 6,345,987 | B1 * | 2/2002 | Mori et al. | 439/66 |
| 6,585,527 | B2 * | 7/2003 | Koopman et al. | 439/71 |
| 6,843,659 | B2 * | 1/2005 | Liao et al. | 439/66 |
| 6,942,495 | B2 * | 9/2005 | Liao et al. | 439/66 |
| 7,008,237 | B1 * | 3/2006 | Ma et al. | 439/66 |
| 7,048,549 | B1 * | 5/2006 | Swain | 439/66 |
| 7,052,284 | B2 * | 5/2006 | Liao et al. | 439/66 |
| 7,070,420 | B1 * | 7/2006 | Wakefield et al. | 439/66 |
| 2002/0160632 | A1 * | 10/2002 | Maldonado et al. | 439/66 |
| 2004/0102062 | A1 * | 5/2004 | Liao et al. | 439/66 |
| 2004/0132319 | A1 * | 7/2004 | Richter et al. | 439/66 |
| 2004/0157476 | A1 * | 8/2004 | Maldonado et al. | 439/66 |
| 2004/0203263 | A1 * | 10/2004 | Chen et al. | 439/66 |
| 2004/0203264 | A1 * | 10/2004 | Liao et al. | 439/66 |
| 2004/0235316 | A1 * | 11/2004 | Liao et al. | 439/66 |
| 2004/0266225 | A1 * | 12/2004 | Chiang | 439/66 |
| 2005/0118842 | A1 * | 6/2005 | Perugini | 439/66 |
| 2005/0124183 | A1 * | 6/2005 | Hou | 439/66 |
| 2005/0233606 | A1 * | 10/2005 | Liao et al. | 439/66 |
| 2005/0250353 | A1 * | 11/2005 | Soh | 439/66 |
| 2006/0024987 | A1 * | 2/2006 | Huang et al. | 439/66 |
| 2006/0035484 | A1 * | 2/2006 | Hsu | 439/66 |
| 2006/0040519 | A1 * | 2/2006 | Arai et al. | 439/66 |

* cited by examiner

*Primary Examiner*—Ross Gushi
(74) *Attorney, Agent, or Firm*—Wei Te Chung

(57) ABSTRACT

An LGA connector contact (30) includes a base (31), and a pair of spring arms (32) extending from the base. Each of the spring arms includes an extending section (320), a connecting section (321), and a contacting section (322) adapted for engaging a circuit board's contact pad. The contacting section has an exterior side and an interior side with a recess (323) on the exterior side of the contacting section around a middle portion of the contacting section so as to define at least a pair of contact regions (324) adjacent the recess. The LGA contacting portion is configured to have its contact regions electrically engage with an un-oxidized portion of the circuit board's contact pad, thereby achieving an effective electrical connection between the LGA connector contact and the corresponding circuit board pad.

11 Claims, 4 Drawing Sheets

LAND GRID ARRAY CONNECTOR CONTACT

BACKGROUND OF THE INVENTION

1. Field of the Invention

The present invention relates to the art of electrical connectors, and more particularly to a land grid array (LGA) connector contact.

2. General Background

Various types of connectors have been developed for electrical connections to an IC package and a printed circuit board, such as Pin Grid Array (PGA) connectors, Ball Grid Array (BGA) connectors, Land Grid Array (LGA) connectors, etc., the names of which are assigned thereto based on conductive elements of the IC package that connectors electrically connect. Contacts resided within the respective connectors are accordingly classified as PGA contacts, BGA contacts, LGA contacts and so on.

As shown in FIGS. 4 and 5, a conventional LGA connector contact 1 generally includes a retention portion 10 for being retained in a passageway (not shown) of an LGA electrical connector, a pair of spring arms 12 extending from an upper portion and a lower portion of the retention portion 10, respectively. A tiny contacting portion 121 is formed at a distal portion of each of the spring arms 12 for electrically mating with a contact pad of a circuit board, such as an IC package or a printed circuit board (not shown). In general, the contacting portion 121 in width is less than that of a corresponding spring arm 12, and cannot provide a sufficient mating face for mating with a corresponding pad of the circuit board. Further, the circuit board's contact pad is prone to be oxidized around a central portion of the circuit board's contact pad, at which the LGA contacting portion often mates the circuit board's contact pad. Mating the LGA contact portion 121 with that oxidized portion of the circuit board pad will cause electrical connection failure between some circuit board pads and the corresponding LGA connector contacting portions. In addition, the LGA connector contact 1 is configured to have a single spring arm at one side thereof, thereby having no good elasticity thereof.

SUMMARY OF THE INVENTION

An LGA connector contact according to an embodiment of the present invention includes a base for being retained in a passageway of the LGA connector, and a pair of spring arms extending from an upper portion and a lower portion of the base respectively. Each of the spring arms includes an extending section extending from the upper portion of the base, a connecting section extending from an upper portion of the extending section, and a contacting section formed at a distal end of the connecting section for engaging a circuit board's contact pad. The contacting section has an exterior side and an interior side, and includes a recess on the exterior side of the contacting section around a middle portion of the contacting section so as to define at least a pair of contact regions adjacent the recess. Compared with the prior art, the LGA contacting portion is configured to have its contact regions electrically engage with an un-oxidized portion of the circuit board's contact pad, thereby achieving an effective electrical connection between the LGA connector contact and the circuit board's contact pad.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
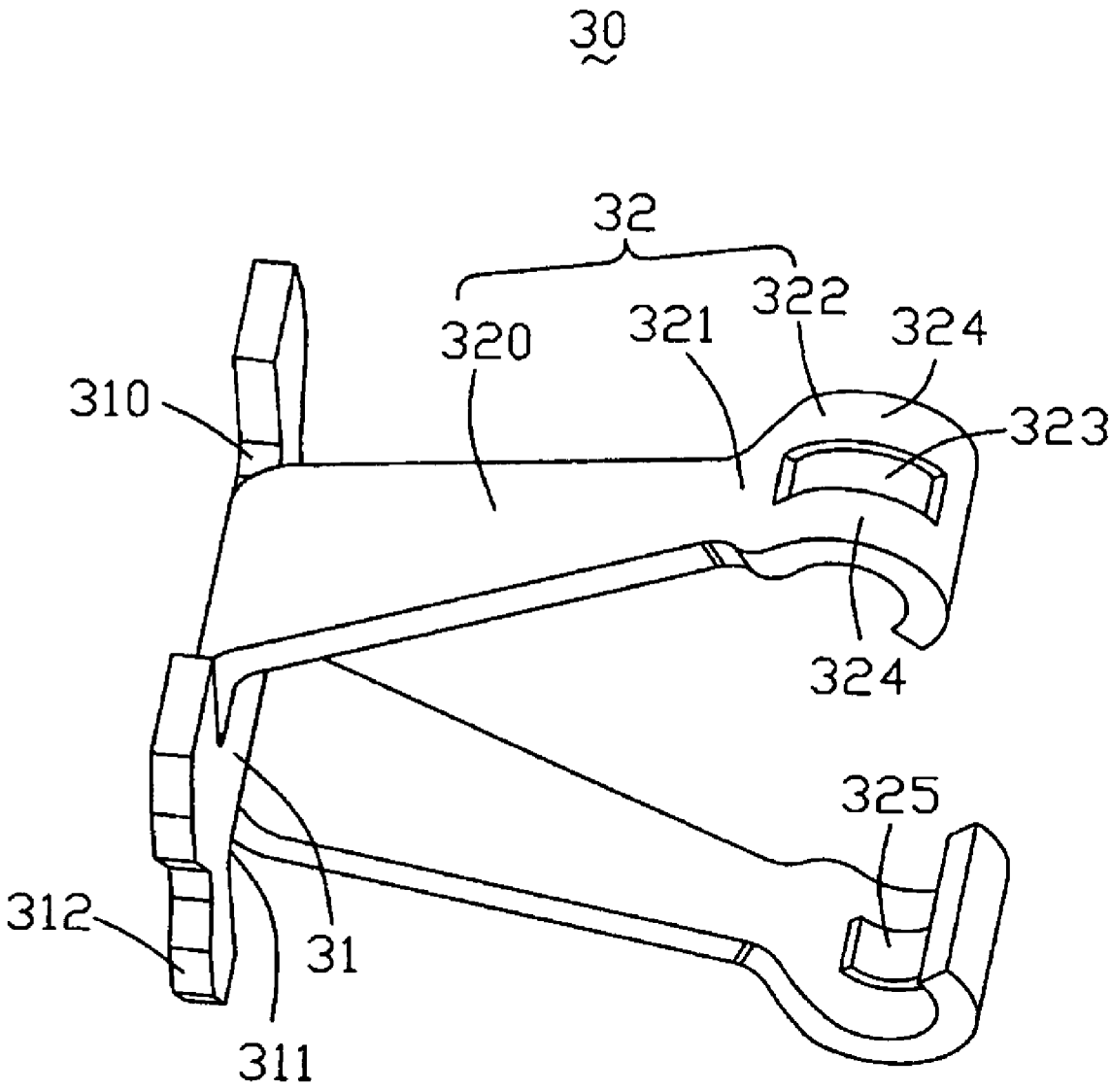
FIG. 1 is a perspective view of an LGA connector contact according to a preferred embodiment of the present invention.
Figure 2:
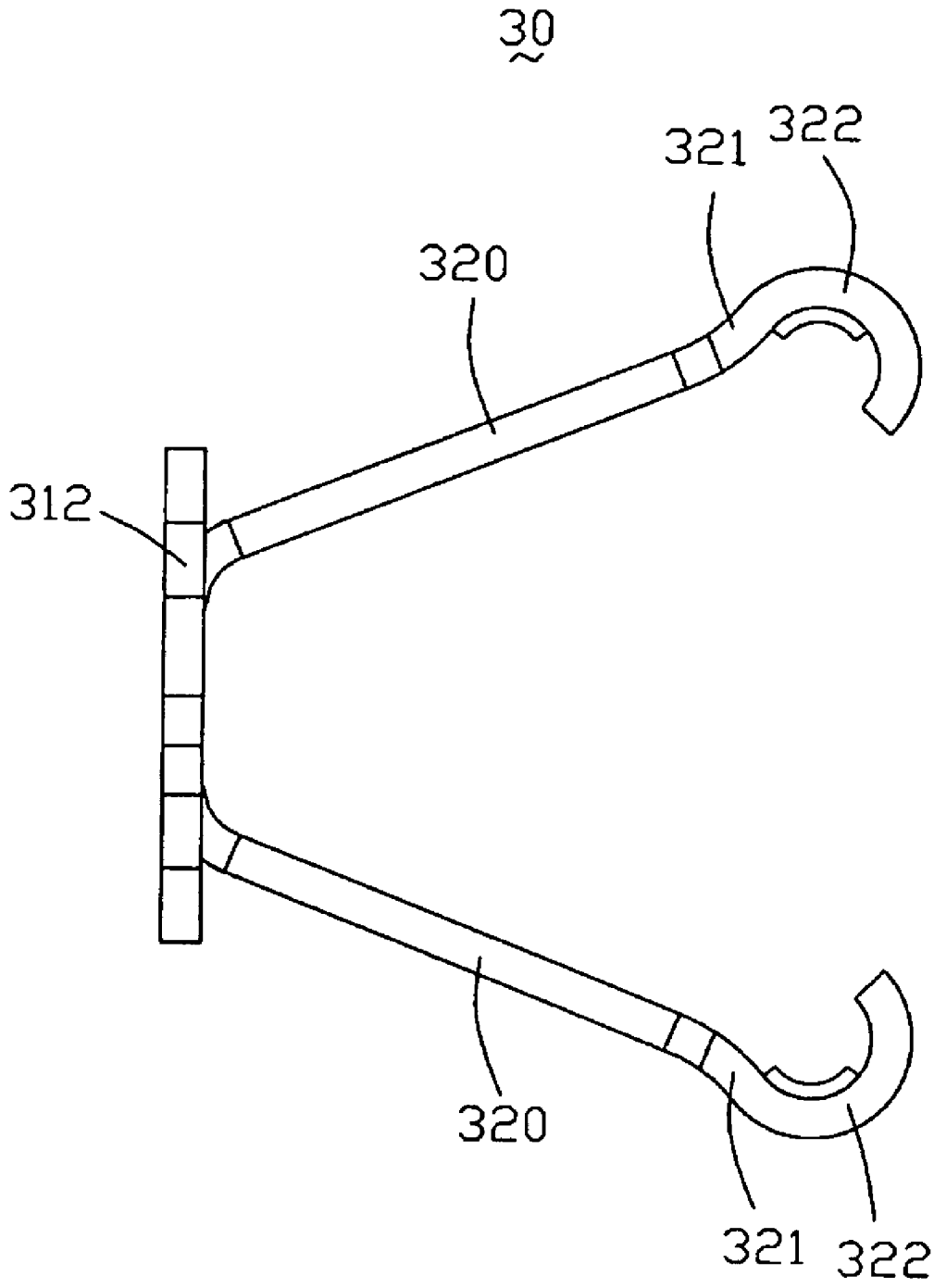
FIG. 2 is a side view of the LGA connector contact of FIG. 1.

Referring to FIGS. 1 and 2, an LGA connector contact 30 according to the preferred embodiment of the present invention is shown to include a base 31 for being interferingly retained in a passageway (not shown) of the LGA connector, and a pair of spring arms 32 extending from an upper portion and a lower portion of the base 31, respectively.

The base 31 is of a plate-like shape, and includes a plurality of barbs 312 formed on an outer edge of the base 31 for being vertically retained in the passageway of the LGA connector with interference fit.

Each of the spring arms 32 includes an extending section 320 extending from the upper portion of the base 31, a connecting section 321 extending from an upper portion of the extending section 320, and a contacting section 322 formed at a distal end of the connecting section 321 for engaging a circuit board's contact pad, such as an IC package's contact pad or a printed circuit board's contact pad. The contacting section 322 in width is larger than that of at least one of the extending section 320 and the connecting section 321. In this embodiment, the width of the contacting section 322 is larger than any one of the extending section 320 and the connecting section 321. Thus, the contacting section 322 can provide a much more mating surface sufficient to electrically contact the whole contact pad of the circuit board than the tiny contacting portion of the conventional LGA contact. Further, the present LGA contact spring arm has a better elasticity than the conventional LGA contact arm, since the present spring arm is composed of two spring sections including the extending section 320 and the connecting section 321.

Each of the contact sections 322 defines a base having an exterior side and an interior side. The contact section 322 includes a recess 323 on the exterior side of the contacting section 322 around a middle portion of the contacting section 322 so as to define at least a pair of contact regions 324 adjacent the recess 323. Thus, the contacting regions 324 are located on opposite sides of the recess 323. In this embodiment, the recess 323 is formed by stamping a part of the contacting section 322 around the middle portion of the contacting section. The recess 323 is preferably arranged corresponding to an oxidized portion of the circuit board's contact pad such that the LGA connector contact 30 electrically mates with the circuit board's contact pad by its contact regions 324 of the LGA contact 30 engaging the remaining un-oxidized portion of the IC package pad, rather than that oxidized portion of the circuit board's contact pad. Thereby, electrical connection failure between the circuit board's contact pad and the LGA contacting portion 322 is prevented due to having the LGA contact 30 engage the un-oxidized portion of the circuit board's contact pad.

While the LGA contact 30 defining one recess 323 to form a pair of contact regions 324 is preferred according to this embodiment of the present invention, the LGA contact 30 having a suitable number of recesses 323 to form a plurality of contact regions 324 can be also employed in other alternative embodiments.

Figure 3:
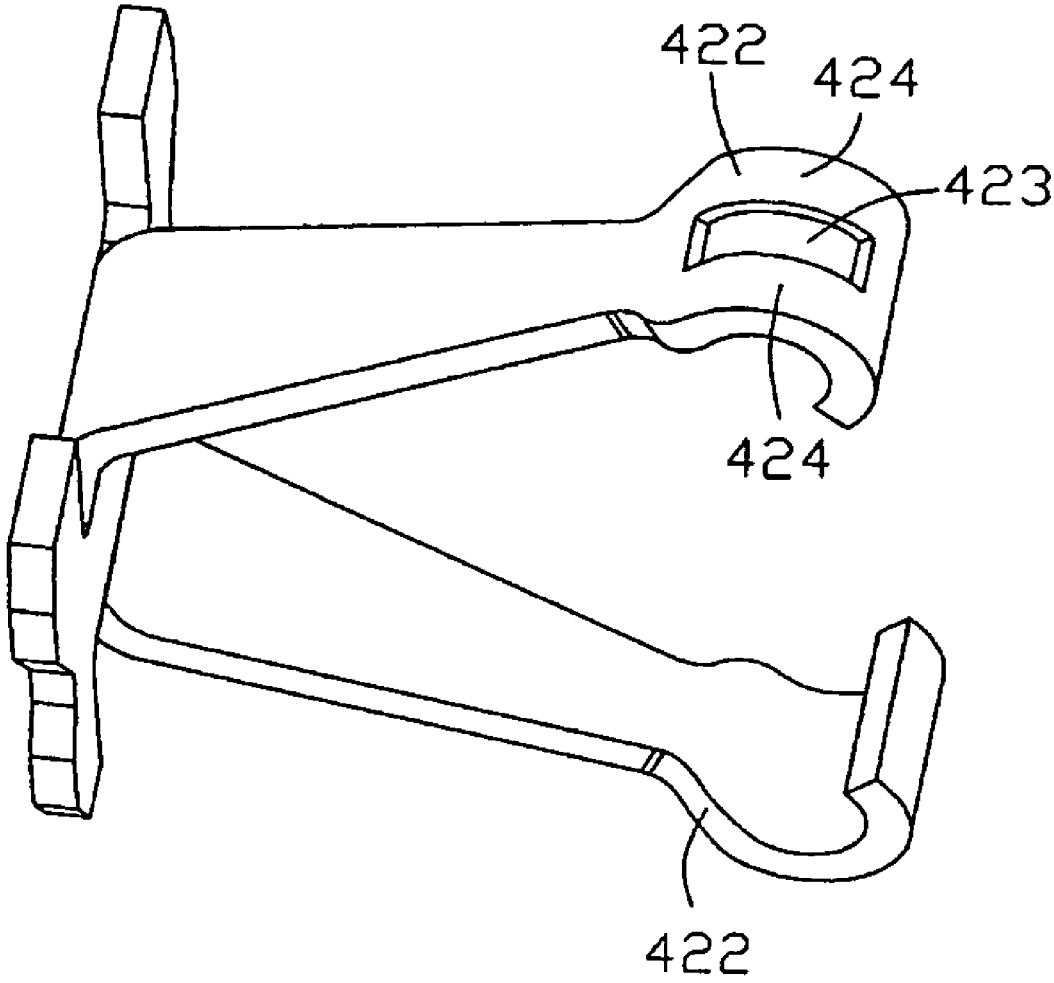
FIG. 3 is a perspective view of a second preferred embodiment in accordance with the present invention.
Figure 4:
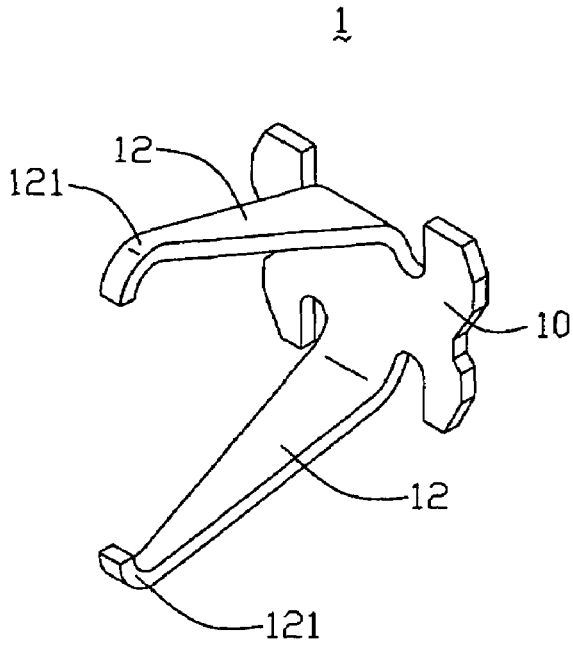
FIG. 4 (PRIOR ART)
FIG. 4 is a perspective view of a conventional LGA connector contact.
Figure 5:
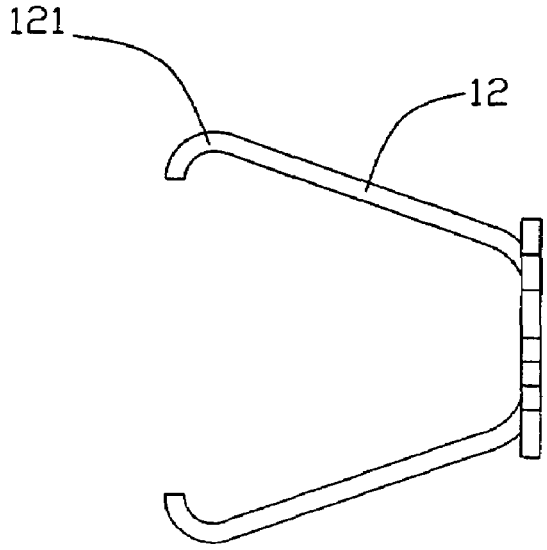
FIG. 5 (PRIOR ART)
FIG. 5 is a side view of the LGA connector contact of FIG. 4.

In another preferred embodiment, referring to FIG. 3, depending on various applications, only one of the contacting sections 422 includes a recess 423 on the exterior side around a middle portion of the contacting section 422 so as to define at least a pair of contact region 424 adjacent the recess 423.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical contact for use in an LGA connector, the electrical contact comprising:

a base for being retained in a passageway of the LGA connector; and a pair of spring arms extending from an upper portion and a lower portion of the base respectively;

each of the spring arms including an extending section extending from the upper portion or the lower portion of the base, a connecting section extending from a far end portion of the extending section, and a contacting section formed at a distal end of the connecting section;

the contacting section having an exterior side and an interior side, the contacting section including a recess on the exterior side of the contacting section around a middle portion of said contacting section so as to define at least a pair of contact regions adjacent said recess.

2. The electrical contact as recited in claim 1, wherein said at least a pair of contact regions is located at opposite sides of said recess.

3. The electrical contact as recited in claim 1, wherein the recess is formed by stamping a part of the contacting section around the middle portion of said contacting section.

4. The electrical contact as recited in claim 1, wherein the contacting section in width is larger than that of the connecting section.

5. The electrical contact as recited in claim 1, wherein the contacting section in width is larger than that of the extending section.

6. The electrical contact as recited in claim 1, wherein the base is of a plate-like shape.

7. The electrical contact as recited in claim 6, wherein the base is vertically disposed within the passageway of the LGA connector.

8. The electrical contact as recited in claim 6, wherein the base includes a plurality of barbs formed on an outer edge of the base.

9. An electrical contact for use in an LGA connector, the electrical contact comprising:

a base for being retained in a passageway of the LGA connector; and a pair of spring arms extending from an upper portion and a lower portion of the base respectively;

each of the spring arms including an extending section extending from the base, a connecting section extending from a far end portion of the extending section, and a contacting section formed at a distal end of the connecting section;

the contacting section having an exterior side and an interior side, at least one of the contacting sections of said spring arms including a recess on the exterior side of the contacting section around a middle portion of said contacting section so as to define at least a pair of contact regions adjacent said recess.

10. The contact as claimed in claim 9, wherein the middle portion essentially keeps a same thickness along a transverse direction through said contact regions and said recess.

11. The contact as claimed in claim 9, wherein the recess extends along an extension direction of said spring arm under an arc configuration from a side view in compliance with that of the contact section.

* * * * *